US005790923A

United States Patent [19]

Oguma et al.

[11] Patent Number: 5,790,923

[45] Date of Patent: Aug. 4, 1998

[54] DEVELOPING APPARATUS

[75] Inventors: Toru Oguma, Susono; Kazushi Watanabe; Atsushi Numagami, both of Mishima, all of Japan

[73] Assignee: Canon Kabushiki Kaisha, Tokyo, Japan

[21] Appl. No.: 797,468

[22] Filed: Feb. 6, 1997

[30] Foreign Application Priority Data

Feb. 9, 1996 [JP] Japan ..... 8-046944

[51] Int. Cl.[6] ..... G03G 15/08

[52] U.S. Cl. ..... 399/106; 399/104; 399/105

[58] Field of Search ..... 399/102, 103, 399/104, 105, 106

[56] References Cited

U.S. PATENT DOCUMENTS

| | | | |
|---|---|---|---|
| 5,134,960 | 8/1992 | Shirai | 399/105 |
| 5,187,326 | 2/1993 | Shirai | 399/104 |
| 5,267,007 | 11/1993 | Watanabe et al. | 399/104 |
| 5,287,148 | 2/1994 | Sakemi et al. | 399/104 |
| 5,294,960 | 3/1994 | Nomura et al. . | |
| 5,450,169 | 9/1995 | Hart et al. | 399/104 |
| 5,475,467 | 12/1995 | Watanabe et al. . | |
| 5,552,864 | 9/1996 | Malicki et al. | 399/104 |
| 5,697,021 | 12/1997 | Watanabe et al. | 399/102 |

FOREIGN PATENT DOCUMENTS

| | | |
|---|---|---|
| 61-175663 | 8/1986 | Japan . |
| 7-199649 | 8/1995 | Japan . |
| 8-030094 | 2/1996 | Japan . |
| 8-137258 | 5/1996 | Japan . |
| 8-137259 | 5/1996 | Japan . |
| 8-202152 | 8/1996 | Japan . |
| 8-202153 | 8/1996 | Japan . |

*Primary Examiner*—Matthew S. Smith

*Attorney, Agent, or Firm*—Fitzpatrick, Cella, Harper & Scinto

[57] ABSTRACT

A developing apparatus includes a container, having an opening, for containing magnetic developer; a developer carrying member, rotatably disposed in the opening, for carrying the magnetic developer; a magnetic sealing member disposed spaced from a peripheral surface of the developer carrying member; and a guiding member for guiding the developer inwardly in a longitudinal direction of the developer carrying member, the guiding member being disposed adjacent an end, in a peripheral direction of the developer carrying member, of the magnetic sealing member.

8 Claims, 6 Drawing Sheets

DEVELOPING APPARATUS

FIELD OF THE INVENTION

The present invention relates to a developing apparatus which develops an electrostatic image on an image bearing member. In particular, it relates to a developing apparatus in which a focused magnetic field is used to seal the end portions of the developing device.

DESCRIPTION OF THE RELATED ART

In an electrophotographic image forming apparatus such as a printer or a copy machine, a latent image is formed by exposing the selected surface areas of an image bearing member having been uniformly charged, and the thus formed latent image is visualized as a toner image as it is developed with the toner borne on a developer carrier member. Then, the toner image is transferred onto a recording medium to complete a print.

A developing apparatus for developing a latent image is provided with sealing members for preventing developer (toner) from seeping out of the developing apparatus. They are located at both longitudinal ends of a developer carrying rotary member (developing sleeve). In the past, elastic material such as felt or foamed rubber has been widely used as the material for the sealing member. A typical usage of such material is illustrated in FIGS. 6 and 7. FIG. 6 is a section of the essential structure of the sealing member in a conventional developing apparatus, and FIG. 7 is a longitudinal section of the structure of the same.

Referring to FIG. 6, a developing sleeve 5 as a developer carrier member contains a magnetic roller 6, and is disposed in a toner container 3 as a developer container, being rotatively supported by a sleeve bearing 12 fixed to the toner container 3, as illustrated in FIG. 7. Thus, the toner supplied from the toner container 3 is adhered to the surface of the developing sleeve 5 by the magnetic force of the magnetic roller 6, and forms a layer of toner. As the developing sleeve 5 is rotated, the thickness of the toner layer is regulated by a development blade 7 so that it becomes a predetermined one. As the developing sleeve 5 is further rotated, the adhered toner is conveyed to a point where the distance between a latent image on a photosensitive drum 1 and the layer of the adhered toner on the developing sleeve 5 becomes shortest, and at this point, the toner adheres to the latent image, developing it. Both longitudinal ends of the developing sleeve 5 are fitted in an elastic sealing member 8. The elastic sealing member 8 is attached to the toner container 3, being positioned substantially behind the developing sleeve 5 as seen from the direction of the photosensitive member 1. As this elastic sealing member 8 is pressed upon the peripheral surface of the developing sleeve 5, toner is prevented from seeping out of the developing apparatus.

However, the above structure also has problems. For example, the elastic sealing member 8 generates a large load as it is pressed upon the peripheral surface of the developing sleeve 5. Further, the elastic sealing member 8 deteriorates through its contact with the developing sleeve 5, losing its ability to seal. In addition, the toner sometimes enters between the developing sleeve 5 and the elastic sealing member 8. Though the amount of the toner which enters between the two components is very small, it is enough to increase or fluctuate the torque necessary to rotate the developing sleeve. The torque fluctuation disturbs the rotational speed of the developing sleeve 5, which has ill effects on image formation.

Therefore, a method for solving the above described problems has been proposed. According to this method, in order to prevent toner from seeping out, magnetic sealing members are disposed at both longitudinal ends of the developing sleeve 5, in a manner to create a predetermined gap between the developing sleeve 5 and itself.

FIG. 8 is a sectional view of a developing apparatus employing a sealing member 9 of magnetic material, depicting the structure thereof. The magnetic sealing member 9 is disposed at each longitudinal end of the developing sleeve 5, being attached to the toner container 3 in a manner so as to hold a predetermined gap g between the peripheral surface of the developing sleeve 5 and itself. The developing sleeve 5 contains a magnet 10, generating a magnetic field whose magnetic flux concentrates between the magnetic sealing member 9 and the magnetic poles of the magnet 10. This concentration of magnetic flux forms the toner in the gap g1, into a magnetic brush of toner. As a result, toner is prevented from seeping or leaking out of the developing area.

In FIG. 8, the magnetic sealing member 9 is formed of magnetic metal, and the magnet 10 is contained in the developing sleeve 5, but instead, the members designated by the reference numerals 9 and 10 may be replaced with a magnet in the form of the sealing member and a member of magnetic material, respectively.

As described above, when a magnetic field is used as a sealing means, the gap between the developing sleeve 5 and the magnetic sealing member 9 can be sealed without physical contact between them. Therefore, the torque necessary to rotate the developing sleeve 5 can be reduced, which warrants usage of a small and inexpensive motor for driving the developing sleeve 5. Further, the fluctuation of the torque necessary to drive the developing sleeve 5 is also reduced; therefore, the rotational speeds of the developing sleeve 5 and the photosensitive drum 1 are not liable to fluctuate as much as when the contact type sealing member is employed. As a result, image quality deterioration traceable to the rotational speed fluctuation of the developing sleeve 5 and photosensitive member 1 can be eliminated. In addition, since there is no friction between the magnetic sealing member 9 and the developing sleeve 5, the magnetic sealing member 9 can be semipermanently used; it can be simply recycled. Next since the method employing a magnetic sealing member is a method in which toner is held by magnetic force in the gap g formed between the developing sleeve 5 and the magnetic sealing member 9, it is necessary to increase the density of the magnetic flux in the gap g in order to increase the toner sealing performance. For example, in the case of a process cartridge removably installable in the main assembly of an image forming apparatus, the cartridge is installed or removed by a user; therefore, the vibrations or the shocks are generated as the cartridge is handled by the user, and these vibrations and shocks are liable to cause toner leakage. Thus, the magnetic force of the magnets 10 and 13 must be increased.

Also, in the case of the structure employing a magnetic seal, as the developing sleeve 5 rotates, a portion of the toner within the gap g adheres to the surface of the developing sleeve 5, forming a toner layer thereon, and comes out of the exit side g1 of the gap g. This portion of the toner re-enters the gap g from the entrance side g2 of the gap g, as the developing sleeve 5 rotates. However, when the magnetic flux density is high, this portion of the toner is liable to accumulate at the entrance side g2 of the gap g, and eventually seeps out of the developing apparatus, as the developing operation is repeated.

SUMMARY OF THE INVENTION

A primary object of the present invention is to provide a developing apparatus employing a magnetic seal.

Another object of the present invention is to provide a developing apparatus which does not collect developer at the end portion of the magnetic seal, and also does not leak developer.

According to an aspect of the present invention, there is provided a developing apparatus comprising a container, having an opening, for containing magnetic developer; a developer carrying member, rotatably disposed in the opening, for carrying the magnetic developer; a magnetic sealing member disposed spaced from a peripheral surface of the developer carrying member; and a guiding member for guiding the developer inwardly in a longitudinal direction of the developer carrying member, the guiding member being disposed adjacent an end, in a peripheral direction of the developer carrying member, of the magnetic sealing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, preferable embodiments of the present invention will be described with reference to the drawings.

Figure 1:
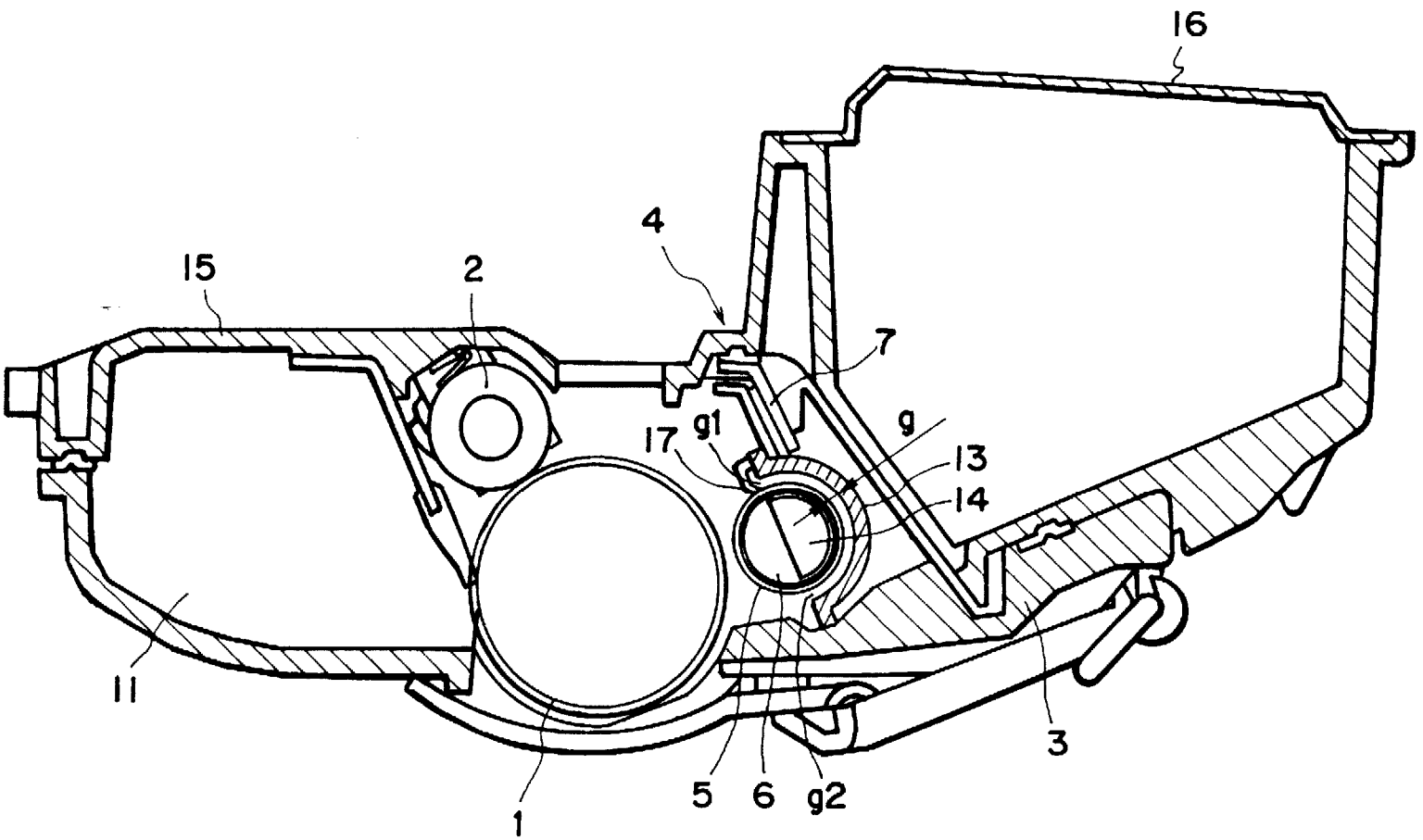
FIG. 1 is a sectional view of the process cartridge in the first embodiment of the present invention, depicting the structure thereof.
Figure 2:
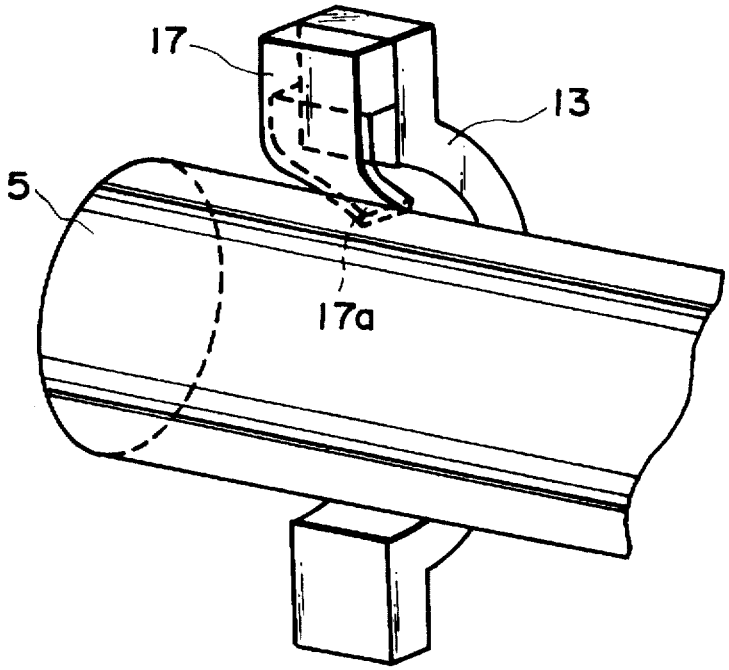
FIG. 2 is a perspective view of the magnetic seal portion in the first embodiment of the present invention.

FIGS. 1 and 2 depict the first embodiment of the present invention. FIG. 1 is a sectional view of a process cartridge comprising a developing apparatus, and FIG. 2 is an enlarged perspective view of a portion of the sealing portion in the developing apparatus.

The process cartridge comprises an image bearing member and at least one processing means. As for the processing means, there are charging means for charging the surface of an image bearing member, developing means for forming a toner image on an image bearing member, cleaning means for removing the toner remaining on an image bearing member, and the like.

Referring to FIG. 1, the process cartridge in this embodiment is removably installable in the main assembly of an image forming apparatus, and comprises an electrophotographic photosensitive member 1 as an image bearing member, charging means 2, a toner container 3 as a developing container, a developing sleeve 5 as a developer carrier member, developing means 4 comprising a development blade 7 or the like, and cleaning means 11. These components are integrally disposed in a process cartridge housing in such a manner that the photosensitive member 1 is surrounded by the rest. The toner container 3 holds single component magnetic toner (developer) which contains magnetic particles. The housing is constituted of frames 15 and 16.

The developing sleeve 5 contains a magnetic roller 6, and is disposed in the toner container 3, being rotatively supported by a sleeve bearing (unillustrated) fixed to the toner container 3. The toner fed out of the toner container 3 is adhered to the surface of the developing sleeve 5 by the magnetic force of the magnetic roller 6, forming a toner layer. As the developing sleeve 5 rotates, the toner layer is regulated by the development blade 7 to give it a predetermined thickness, and then is conveyed to a point where the distance from the toner layer to the latent image on the photosensitive drum 1 as an image bearing member becomes shortest. At this point, the toner particles in the toner layer adhere to the latent image; in other words, the latent image is developed.

The developing means 4 is provided with a magnet 13 as a magnetic sealing member, which is disposed at each longitudinal end of the developing sleeve 5, being attached to the toner container 3 in such a manner that a predetermined gap g is formed between the peripheral surface of the developing sleeve 5 and itself. In the developing sleeve 5, a magnetic member 14 of magnetic metal is disposed across the thickness of the sleeve from the magnet 13. With this arrangement, a concentrated magnetic field is formed between the magnet 13, and a magnetic pole of the magnetic member 14 enveloped in the developing sleeve 5, wherein the toner in the gap g is formed into a magnetic brush, thus preventing the inside toner from leaking out of the development area.

The process cartridge in this embodiment also comprises a toner guide member 17 formed of elastic material. The guide member 17 is disposed in contact with the surface of the developing sleeve 5, on the upstream side of the area where the latent image on the photosensitive drum 1 is developed, that is, adjacent to the exit side g1 of the gap g in which the magnetic seal is formed. The guide member 17 is located at the same position as the magnet 13, in terms of the longitudinal direction of the developing sleeve 5, and diagonally extends toward the developing sleeve 5 against the rotational direction of the developing sleeve 5. The guide member 17 is counterdirectionally contacted to the developing sleeve with respect to the direction of movement of the surface of the developing sleeve 5. The free end 17*a* of the guide member 17 is inclined (non-parallel with respect to the movement direction of the surface of the developing sleeve 5) so that the inner (in the longitudinal direction) part thereof is downstream with respect to the movement direction of the surface of the developing sleeve. With this arrangement, as the developing sleeve 5 rotates, the guide member 17 scrapes the toner on the surface of the developing sleeve 5, and the inclined end surface thereof guides it in the longitudinally inward direction of the developing sleeve 5, preventing a portion of the magnetic brush (toner) from being carried from the exit side g1 to the entrance side g2, and accumulated at the entrance side g2. Therefore, the magnetic force of the magnetic seal may be increased to keep toner more effectively sealed while the cartridge is handled by a user, as well as while it is in operation.

Further, even though the guide member 17 is in contact with the developing sleeve 5, there is practically no need for torque increase, since the contact area is very small. Therefore, one of the desirable effects of the employment of a magnetic seal, that is, a reduced torque requirement, is not canceled by the employment of the guide member 17.

Figure 3:
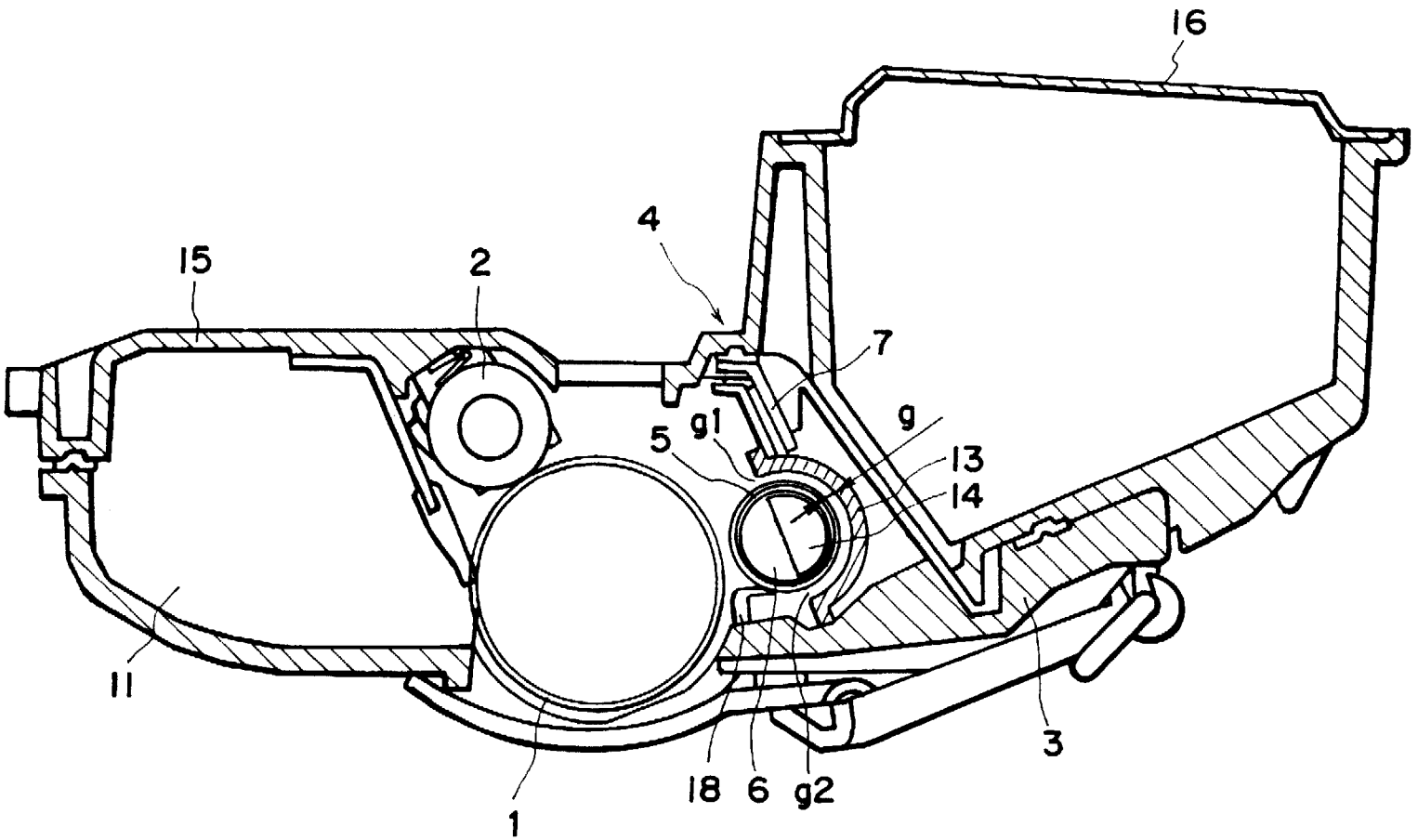
FIG. 3 is a sectional view of the process cartridge in the second embodiment of the present invention, depicting the structure thereof.
Figure 4:
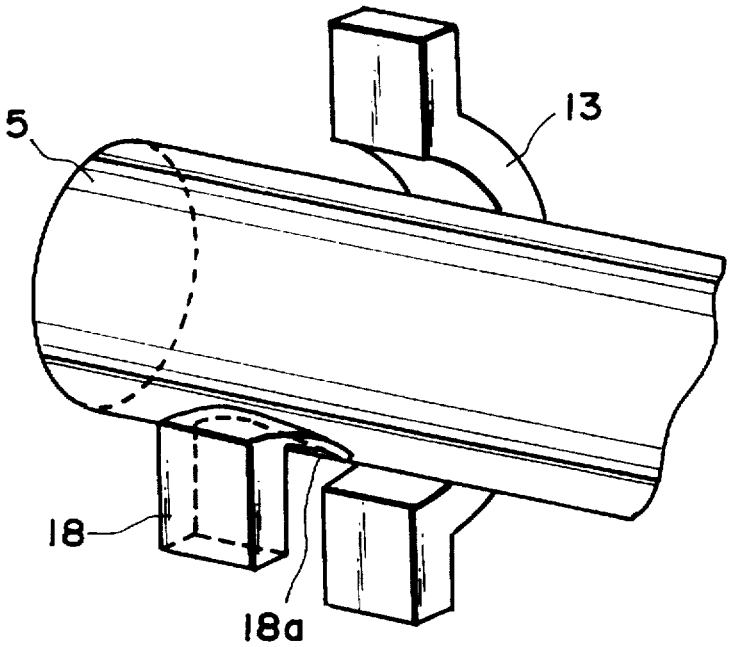
FIG. 4 is a perspective view of the magnetic seal portion in the second embodiment of the present invention.

FIGS. 3 and 4 depict another embodiment of the present invention. FIG. 3 is a sectional view of a process cartridge, and FIG. 4 is an enlarged perspective view of a portion of the sealing portion in the process cartridge.

In this second embodiment, a guide member 18 is disposed adjacent to the entrance side g2 of the gap g. Referring to FIG. 4, the position of the guide member 18 in terms of the longitudinal direction of the developing sleeve 5 is the same as the position of the magnet 13, just as the position of the guide member 17 in terms of the longitudinal direction of the developing sleeve 5 is the same as the position of the magnet 13 in the first embodiment. However, contrary to the way the guide member 17 in the first embodiment diagonally extends against the rotational direction of the developing sleeve 5, the guide member 18 diagonally extends in the same direction as the rotational direction of the developing sleeve 5, and contacts the surface of the developing sleeve 5, on the side which faces the photosensitive drum 1, by the tip portion 18*a*. The tip portion 18*a* is tapered in such a manner that as the toner adheres to the surface of the developing sleeve 5, on the area corresponding to the magnetic seal, and reaches the guide member 18, it is scraped by the tip portion 18*a*, and then is guided by the same in the longitudinally inward direction of the developing sleeve 5. This arrangement can also prevent the developer from accumulating at the entrance side g2 of the gap g, and eventually seeping out of the developing apparatus.

Figure 5:
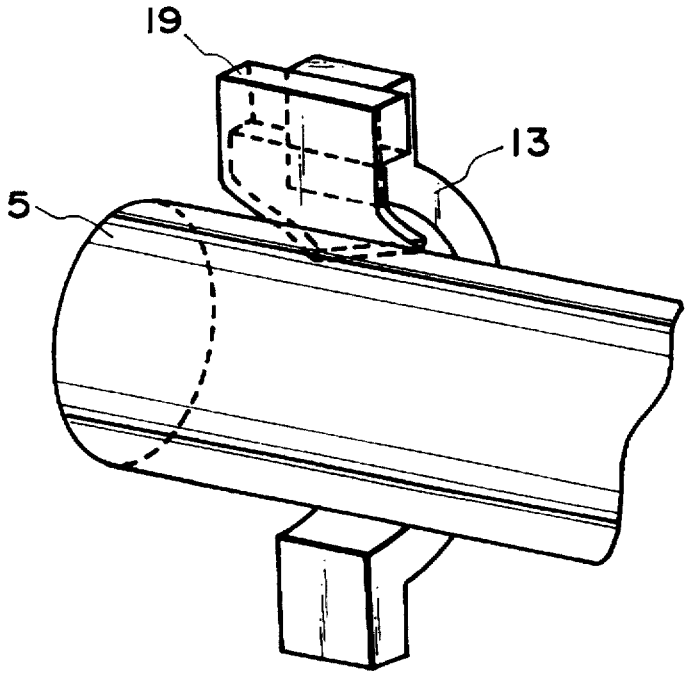
FIG. 5 is a perspective view of the magnetic seal portion in the third embodiment of the present invention.
Figure 6:
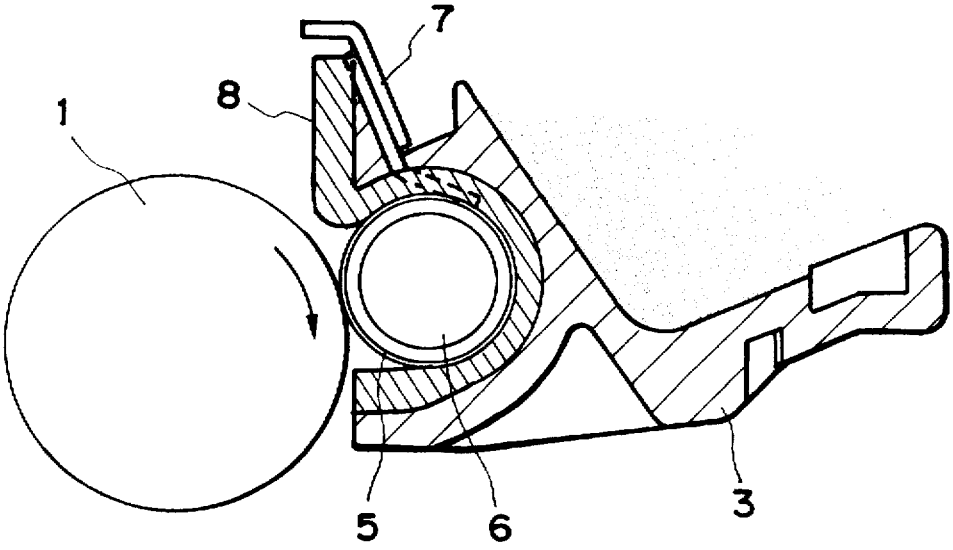
FIG. 6 is a sectional view of the seal portion of the developing device in a conventional process cartridge, depicting the essential structure thereof.
Figure 7:
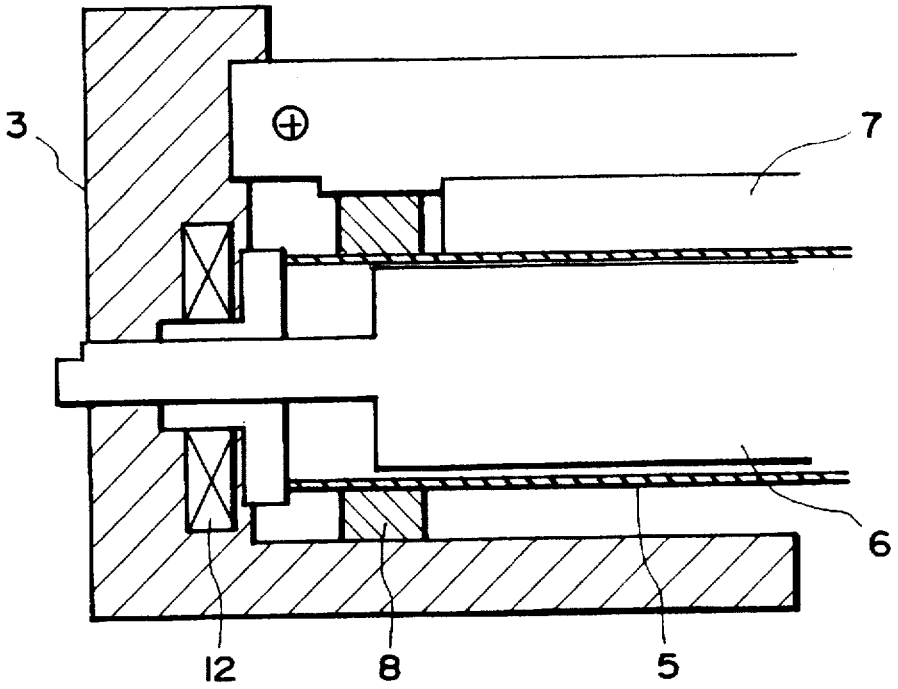
FIG. 7 is a longitudinal sectional view of the seal portion of the developing device in the conventional process cartridge, depicting the essential structure thereof.
Figure 8:
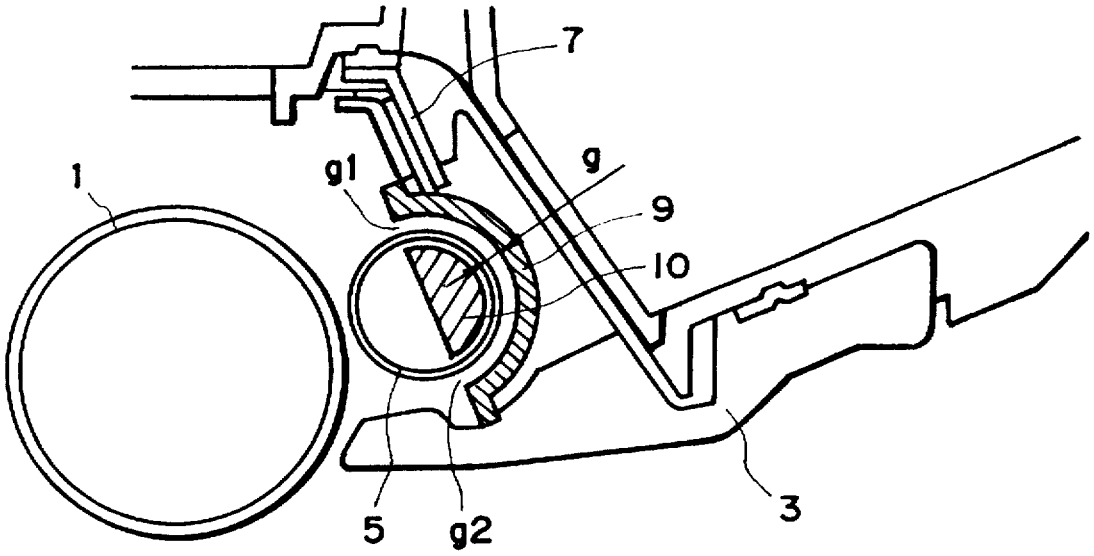
FIG. 8 is a sectional view of the seal portion of the developing device employing a magnetic sealing member, depicting the essential structure thereof.

FIG. 5 depicts the third embodiment of the present invention. In this embodiment, the edges of the guide member 19 in the longitudinal direction of the developing sleeve 5 extend beyond the corresponding edges of the magnet 13. Therefore, the toner, which adheres to the developing sleeve 5, in the magnetic seal area, and comes out to the side which faces the photosensitive member 1, can be more reliably scraped, and guided in the longitudinally inward direction of the developing sleeve 5, by the guide member 19. In other words, it is possible to prevent more reliably the toner from accumulating at the entrance side g2 of the gap g.

In the preceding embodiments, a piece of magnetic metal is disposed within the developing sleeve 5, and the sealing member 13 is a magnet. However, the positional relationship between the magnetic metal and a magnet may be reversed; a piece of magnet may disposed in the developing sleeve 5, and the sealing member 13 may be made of magnetic metal. Further, both components may be constituted of a piece of magnet.

Here, a magnetic roller for holding magnetic developer on the surface of a developing sleeve may be placed in the developing sleeve in such a manner that the magnetic flux of the magnetic field generated by the magnetic roller and a magnetic seal is substantially concentrated in a gap formed between the magnet roller and the magnetic seal.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a container, having an opening, for containing magnetic developer;

a developer carrying member, rotatably disposed in the opening, for carrying the magnetic developer;

a magnetic sealing member disposed spaced from a peripheral surface of said developer carrying member; and a guiding member for guiding the magnetic developer inwardly in a longitudinal direction of said developer carrying member, said guiding member being disposed adjacent an end, in a peripheral direction of said developer carrying member, of said magnetic sealing member, and said guiding member having a guiding portion disposed between said magnetic sealing member and said developer carrying member.

2. An apparatus according to claim 1, wherein the magnetic developer is toner, and said magnetic sealing member includes a magnet for forming a concentrated magnetic field.

3. An apparatus according to claim 1, wherein said guiding member has an end which is inclined and contacted to said peripheral surface of said developer carrying member.

4. An apparatus according to claim 3, wherein said end of said guiding member is inclined such that an end, in the longitudinal direction of said developer carrying member, of said end of said guiding member, is downstream with respect to a movement direction of said peripheral surface of said developer carrying member.

5. An apparatus according to claim 1, wherein said guiding member is disposed adjacent a developer outlet portion.

6. An apparatus according to claim 1, wherein said guiding member is disposed adjacent a developer returning portion.

7. An apparatus according to claim 1, wherein said guiding member is extended to outside said magnetic sealing member in a longitudinal direction of said developer carrying member.

8. An apparatus according to claim 1, wherein said developing apparatus is unified into a cartridge with an image bearing member for bearing an electrostatic image, and said cartridge is detachably mountable to a main assembly of an image forming apparatus.

* * * * *